US008647134B2

(12) United States Patent
Schulte et al.

(10) Patent No.: US 8,647,134 B2
(45) Date of Patent: Feb. 11, 2014

(54) CHARGE CORD LOCK FOR ELECTRIC VEHICLE

(75) Inventors: Edward L. Schulte, White Lake, MI (US); Alvin N. Standard, Clarkston, MI (US); Gary W. Krajenke, Warren, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 52 days.

(21) Appl. No.: 13/429,874

(22) Filed: Mar. 26, 2012

(65) Prior Publication Data

US 2013/0252448 A1 Sep. 26, 2013

(51) Int. Cl.
*H01R 13/62* (2006.01)

(52) U.S. Cl.
USPC ..... 439/304

(58) Field of Classification Search
USPC ..... 439/304, 131, 352, 152, 456
See application file for complete search history.

(56) References Cited

U.S. PATENT DOCUMENTS 5,478,250 A * 12/1995 Hoffman ..... 439/142
5,627,448 A * 5/1997 Okada et al. ..... 439/133
6,123,569 A * 9/2000 Fukushima et al. ..... 439/456
8,016,604 B2 * 9/2011 Matsumoto et al. ..... 439/304
8,025,526 B1 * 9/2011 Tormey et al. ..... 439/528
8,197,277 B1 * 6/2012 Teichmann ..... 439/304
8,206,171 B2 * 6/2012 Osawa et al. ..... 439/352
8,206,172 B2 * 6/2012 Katagiri et al. ..... 439/352
8,251,734 B2 * 8/2012 Katagiri et al. ..... 439/352
8,357,001 B2 * 1/2013 Katagiri et al. ..... 439/304
8,357,002 B2 * 1/2013 Katagiri et al. ..... 439/304
8,376,767 B2 * 2/2013 Kahara et al. ..... 439/304
8,376,768 B2 * 2/2013 Kurumizawa et al. ..... 439/304
8,460,028 B2 * 6/2013 Tormey et al. ..... 439/528

* cited by examiner

*Primary Examiner* — Alexander Gilman

(57) ABSTRACT

A charge cord assembly for a vehicle having a charging receptacle for engaging the charge cord during battery recharging. The charge cord assembly includes an electric cord extending between a source of electric current and the charging receptacle; a cord end connector engaging the electric cord and having a electrical socket engaging the charging receptacle, a latch hook that selectively secures the cord end connector to the charging receptacle, a release handle, a release linkage assembly engaged between the release handle and the latch hook to release the latch hook from the charging receptacle when the release handle is actuated; and a lock assembly having a locked position that prevents the release linkage assembly from releasing the latch hook from the charging receptacle and an unlocked position that allows the release linkage assembly to release the latch hook from the charging receptacle when the release handle is actuated.

11 Claims, 4 Drawing Sheets

CHARGE CORD LOCK FOR ELECTRIC VEHICLE

BACKGROUND OF INVENTION

The present invention relates generally to charging systems for electric, plug-in hybrid electric and other vehicles that employ electric charging cords for charging on-board battery packs, and more particularly to selectively preventing the removal of the electric charging cord.

Some recent automotive vehicles employ on-board battery packs that can be charged while the vehicle is parked. For these vehicles, one end of the plug may be inserted into an electrical outlet in a garage or at a public charging station, and the other end is plugged into a receptacle in the vehicle. While plugged-in, the vehicle batteries charge, thus providing the driver with maximum operating range on battery power when the vehicle is next used. However, while charging, the vehicle operator may not be near the vehicle for extended periods, which allows for others to possibly unplug the charging cord from the vehicle to charge another vehicle or to take the cord. It is desirable, then, to provide a means for allowing the vehicle operator to easily remove the plug from the vehicle while preventing other unauthorized people from doing so.

SUMMARY OF INVENTION

An embodiment contemplates a charge cord assembly for a vehicle having a charging receptacle for engaging the charge cord assembly during battery pack recharging. The charge cord assembly may include an electric cord extending between a source of electric current and the charging receptacle; a cord end connector engaging the electric cord and having a electrical socket engaging the charging receptacle, a latch hook that selectively secures the cord end connector to the charging receptacle, a release handle, a release linkage assembly engaged between the release handle and the latch hook to release the latch hook from the charging receptacle when the release handle is actuated; and a lock assembly having a locked position that prevents the release linkage assembly from releasing the latch hook from the charging receptacle and an unlocked position that allows the release linkage assembly to release the latch hook from the charging receptacle when the release handle is actuated.

An advantage of an embodiment is that charge cord assembly can be easily locked into the charging receptacle on the vehicle so that it cannot be removed by an unauthorized person. In addition, the charge cord lock can be quickly and easily unlocked to remove the charge cord assembly from the vehicle when charging is complete.

DETAILED DESCRIPTION

Figure 1:
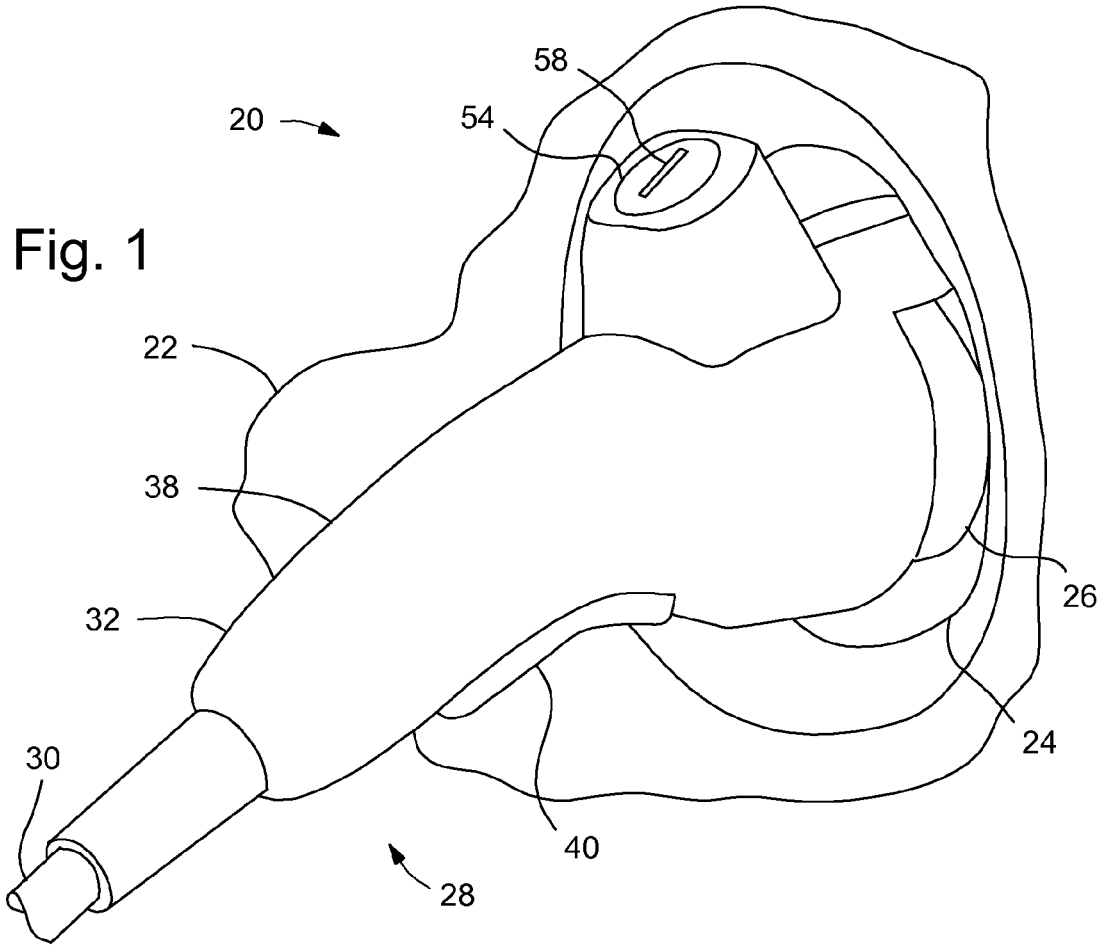
FIG. 1 is a schematic, perspective view of a portion of a charge cord assembly and vehicle.
Figure 2:
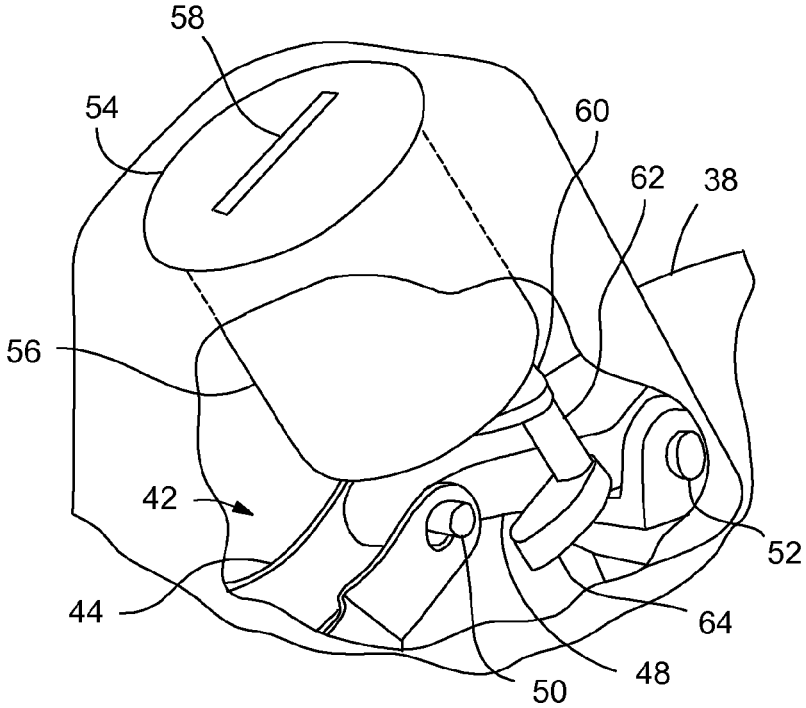
FIG. 2 is a schematic, perspective, partially cutaway view of a portion of the charge cord assembly.
Figure 3:
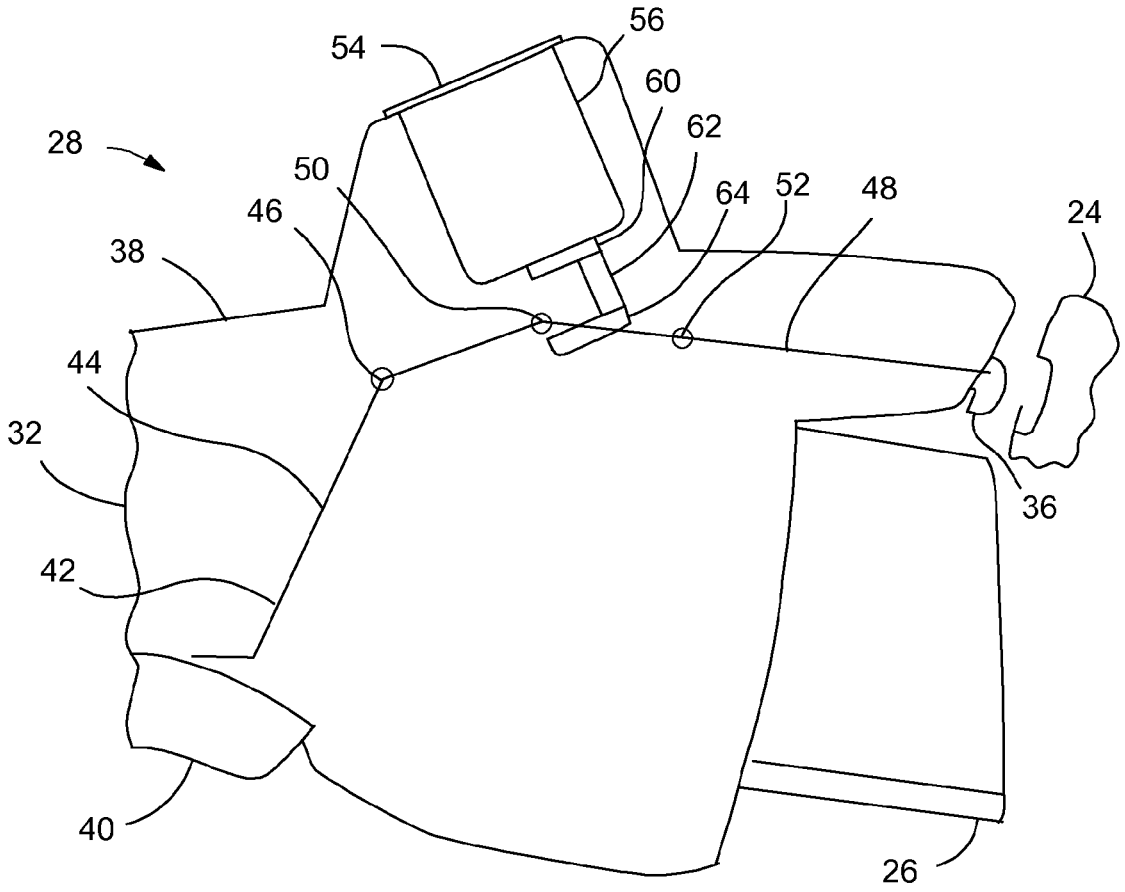
FIG. 3 is a schematic, elevation view of a portion of the charge cord assembly and a vehicle charge receptacle.

Referring to FIGS. 1-3, a vehicle, indicated generally at 20, is shown. The vehicle 20 includes a vehicle body 22 having an opening through which a vehicle charging receptacle 24 is accessible. The charging receptacle 24 receives an electric current for charging an on-board battery pack (not shown). The vehicle 20 may be, for example, an electric or plug-in hybrid electric vehicle. The charging receptacle 24 connects to an electrical socket 26 of a charge cord assembly 28.

The charge cord assembly 28 includes an electric cord 30 that extends from a connector (not shown) at a first end, for connecting to a source of electric current, to a cord end connector 32 at the second end. The cord end connector 32 includes the electrical socket 26 that is connected to the charging receptacle 24 during battery charging. When the electrical socket 26 is seated in the charging receptacle 24, a latch hook 36 engages the charging receptacle 24 to prevent the electrical socket 26 from inadvertently falling out of the charging receptacle 24 during battery charging.

The cord end connector 32 has a connector housing 38 that supports the electric cord 30, the electrical socket 26, a release handle 40, and release linkages 42. The release handle 40 protrudes from the housing and is in a position for easy gripping and actuation by a person. The release linkages 42 connect between the release handle 40 and the latch hook 36 so that, upon squeezing the release handle 40, the release linkages 42 will cause the latch hook 36 to lift up, allowing the electrical socket 26 to be pulled out of the charging receptacle 24.

The release linkages 42 may be configured, for example, as shown schematically in FIGS. 2 and 3. A first lever 44 may engage the release handle 40 at a first end, pivot about a first pivot location 46, and connect to a first end of a second lever 48 at a connection location 50. The second lever 48 may pivot about a second pivot location 52 and connect at a second end to the latch hook 36. Thus, when the release handle 40 is squeezed, the first lever 44 pivots clockwise (as seen in FIG. 3), causing the second lever 48 to pivot counterclockwise (as seen in FIG. 3), which causes the latch hook 36 to lift up. This operation is allowed when a lock assembly 54 in the cord end connector 32 is in an unlocked position (shown in FIG. 2), but is prevented when the lock assembly 54 is in the locked position.

The lock assembly 54 includes a key cylinder 56 secured to the connector housing 38, with a key slot 58 for receiving a key (not shown). The key cylinder 56 may be a conventional type of key cylinder and so will not be shown in more detail herein. The key cylinder 56 may be configured so that the key that works in the key cylinder 56 is also the key for unlocking the vehicle doors or it may be configured for a separate key that only works to operate the lock assembly 54.

The lock assembly 54 also includes a rotating pawl 60, a pawl shaft 62 connected to the rotating pawl 60, and a locking pawl 64 connected to the pawl shaft 62. When the key is inserted into the key slot 58 and rotated in an unlocking direction, the rotation of the key causes the rotating pawl 60 to rotate the locking pawl 64 out of the way of the connection location 50, which allows the release linkages 42 to lift the latch hook 36 when the release handle 40 is squeezed. The rotation of the key in the opposite (locking) direction, causes the rotating pawl 60 to rotate the locking pawl 64 toward the connection location 50. Now if one squeezes the handle, the locking pawl 64 engages the connection location 50, preventing the first lever 44, and hence the second lever 48, from pivoting far enough to lift the latch hook 36 sufficiently to disengage the latch hook 36 from the charging receptacle 24. Thus, the cord end connector 32 cannot be disconnected from the vehicle. This prevents unauthorized persons from disconnecting the charge cord assembly 28.

Figure 4:
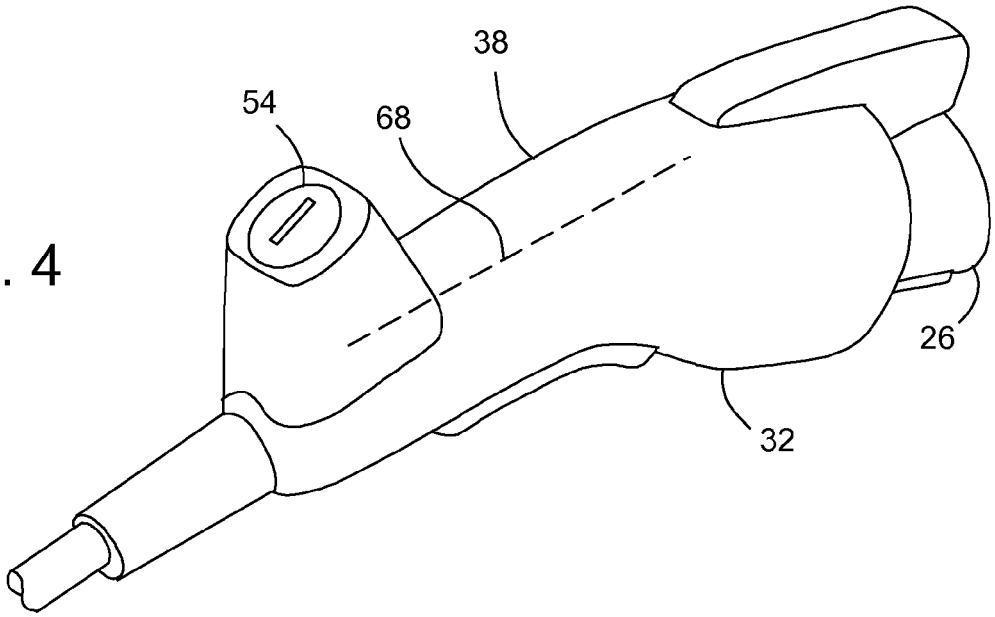
FIG. 4 is a schematic, perspective view of a portion of the charge cord assembly according to another embodiment.

FIG. 4 illustrates an embodiment similar to the first. In this embodiment, the connector housing 38 is modified for the lock assembly 54 to be located in the cord end connector 32 farther from the electrical socket 26. A locking linkage 68, schematically shown, now transfers the motion of the key to the release linkages to selectively allow for (unlocked) and prevent (locked) unlatching of the latch hook from the charging receptacle. The other elements of this embodiment may be the same as in the first embodiment, if so desired.

Figure 5:
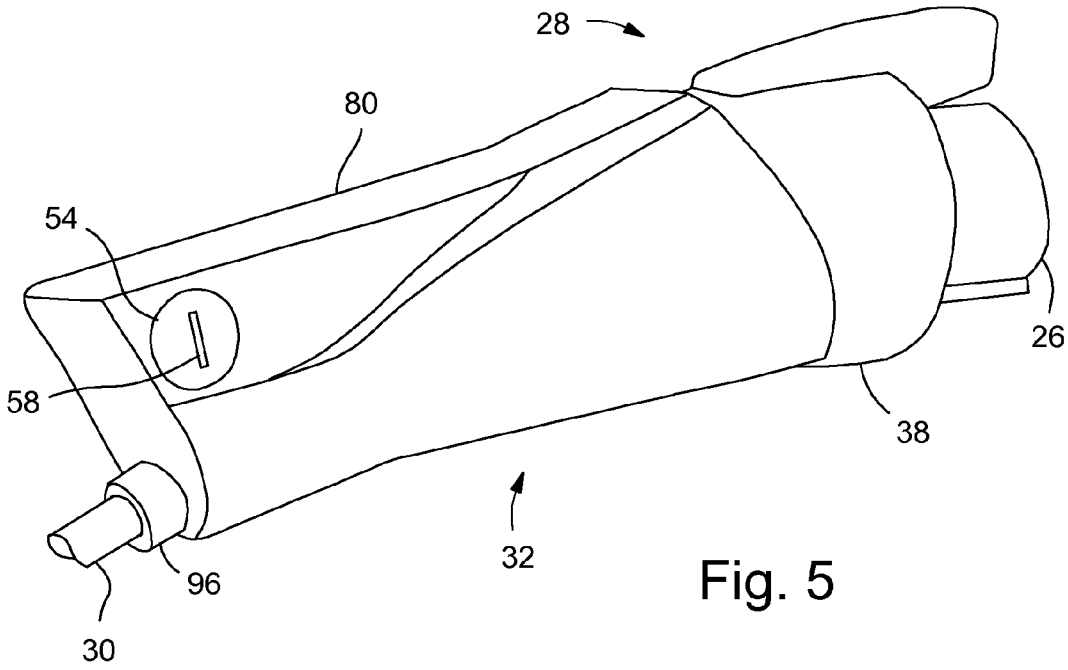
FIG. 5 is a schematic, perspective view of a portion of the charge cord assembly according to another embodiment.
Figure 6:
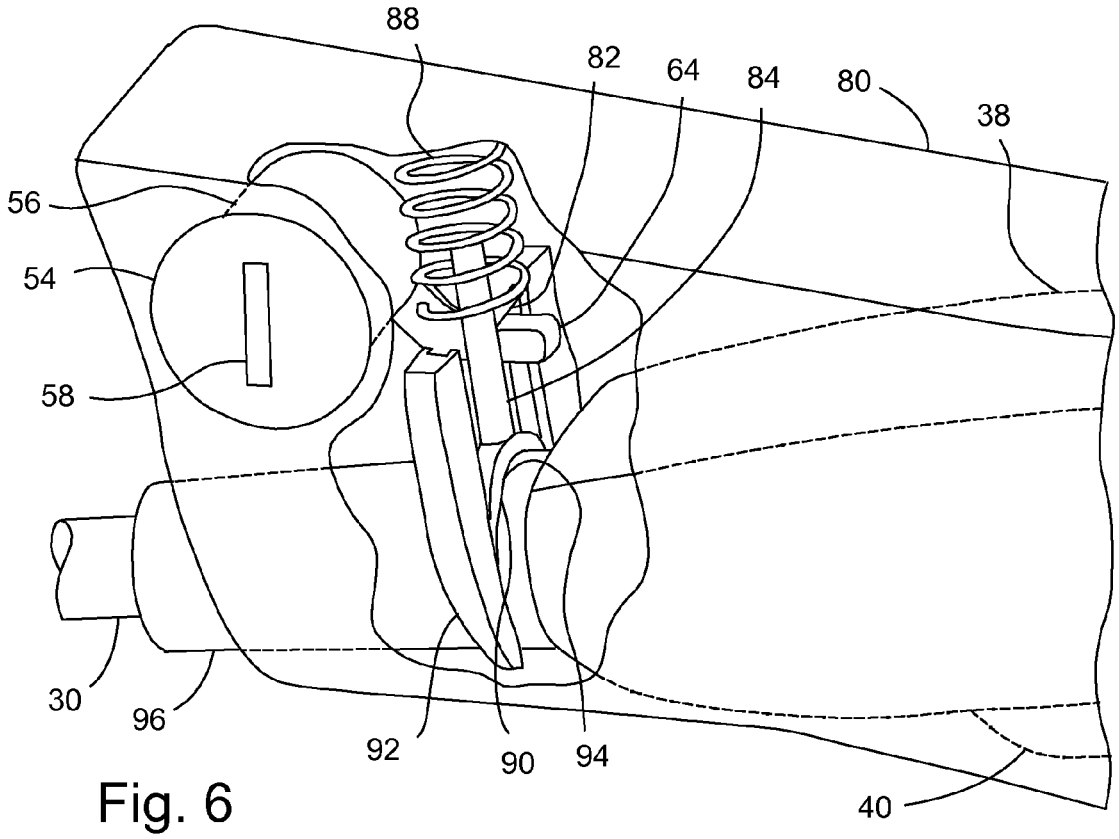
FIG. 6 is a schematic, perspective view of a portion of the charge cord assembly according to the embodiment of FIG. 5.
Figure 7:
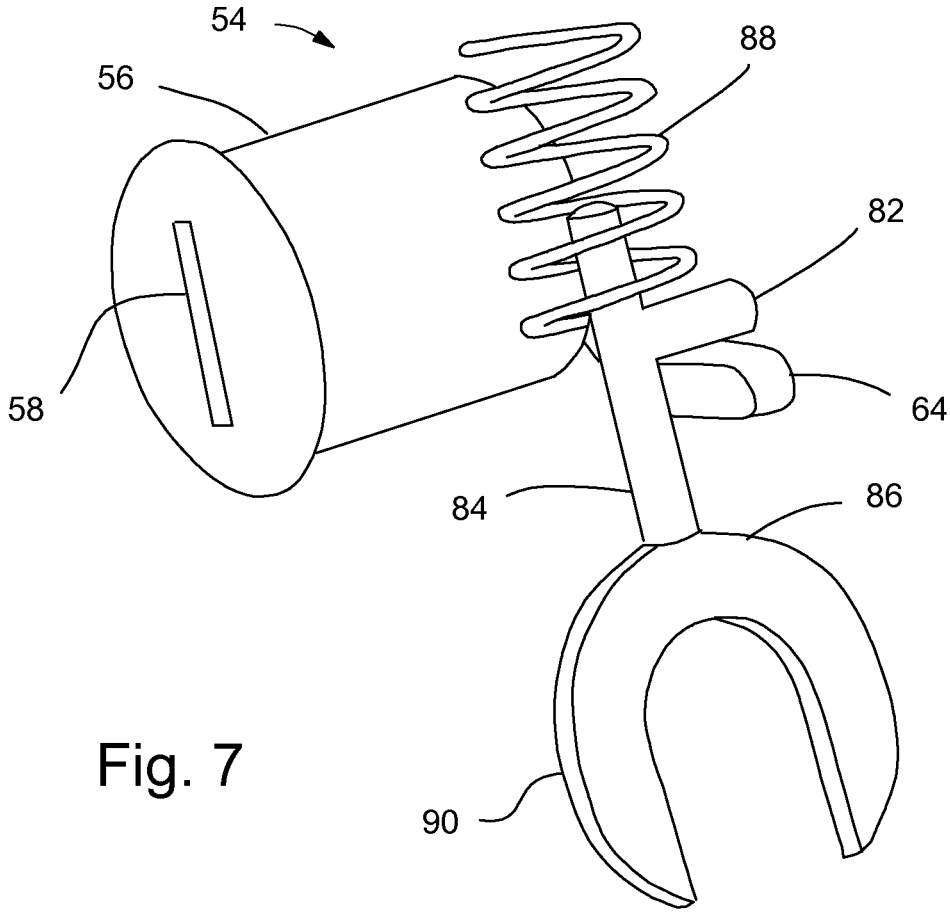
FIG. 7 is a schematic, perspective view of a portion of a lock assembly according to the embodiment of FIG. 5.

FIGS. 5-7 illustrate another embodiment. In this embodiment, a hollow, removable locking cover 80 can be slid along the electric cord 30 and over the top of a portion of the connector housing 38. The locking cover 80 extends over the entire release handle 40 and is stiff enough to prevent one from squeezing the cover 80 to actuate the handle 40. In this way, when the locking cover 80 is in place, the handle 40 cannot be actuated to cause the latch hook to release. The release linkages and latch hook may be the same as those shown in FIGS. 1-3, and so will not be shown in detail in this embodiment. The difference with this embodiment is that, rather than limiting the movement of the release linkages directly when squeezing the release handle in order to lock the handle in place, the release handle itself is blocked from being squeezed in order to indirectly limit the movement of the release linkages, thus locking the handle in place. This arrangement still prevents the removal of the charge cord assembly 28 by unauthorized people.

The locking cover 80 includes a lock assembly 54, which again has a key cylinder 56 with a key slot 58 for receiving a key (not shown). Again, the lock cylinder may be configured to accept the same key that locks and unlocks the car doors or it may be a separate key that only operates to unlock the locking cover 80 from the cord end connector 32.

The lock assembly 54 may include a locking pawl 64 that is pivoted by the rotation of the key in the key cylinder 56. The locking pawl 64 engages a flange 82 extending from a shaft 84 of a C-clip 86. A spring 88 is engaged between the inside of the locking cover 80 and the flange 82 and biases the C-clip 86 in a downward direction (as oriented in FIGS. 6 and 7). Arms 90 of the C-clip 86 slide up and down in clip guides 92, which may be fixed relative to the locking cover 80. The arms 90 slide into a retaining slot 94 of a cord support 96. The cord support 96 may be similar to a conventional, flexible cord support that fits around an electric cord and protects the cord from breakage.

The operation of the locking cover 80 will now be discussed. When one wishes to charge the vehicle battery without others being able to remove the charge cord assembly 28, the key is inserted into the key slot 58 and rotated to lift the locking pawl 64 against the bias of the spring 88. The locking cover 80 is slid along the electric cord 30 and around the connector housing 38. The locking cover 80 may be sized and shaped to allow the cover 80 only to slide on the connector housing 38 a sufficient distance to align the C-clip 86 with the retaining slot 94. Once in place, the key is turned to move the locking pawl 64 in a direction that allows the spring 88 to push the C-clip 86 toward the cord support 96, which causes the arms 90 to slide into the retaining slot 94. This prevents the locking cover 80 from being slid off of the connector housing 38, thus preventing anyone from accessing the release handle 40. The locking cover 80 does not interfere with the connection of the electrical socket 26 to the charging receptacle, so the electrical socket 26 can be connected to the charging receptacle either before or after the locking cover 80 is secured to the connector housing 38. But once connected, the release handle 40 is not accessible to remove the cord end connector 32 from the vehicle. Thus, it is protected from unauthorized removal.

When one is finished charging the battery and wishes to remove the cord end connector 32 from the vehicle, one inserts the key into the key slot 58, and turns the key to cause the locking pawl 64 to lift the C-clip 86 out of the retaining slot 94 against the bias of the spring 88. The locking cover 80 is then free to be slid off of the connector housing 38, giving one access to the release handle 40, which can be actuated to release the latch hook, allowing the cord end connector 32 to be disconnected from the vehicle.

Additional alternatives may include employing a combination lock instead of a key actuated lock. Also, a similar style lock may be added to the other end of the charge cord assembly to prevent the cable from being unplugged from a charging station electrical outlet.

Figure 8:
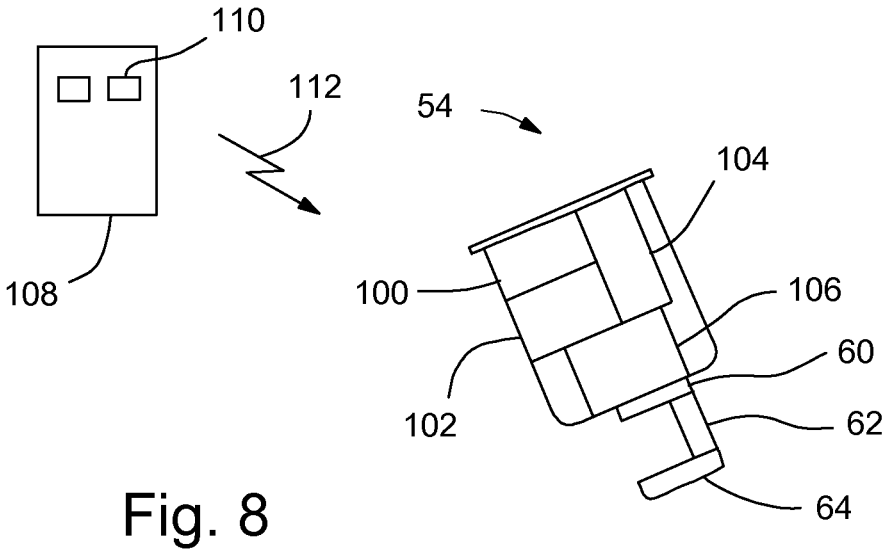
FIG. 8 is a schematic view of a portion of the lock assembly of FIG. 3, but illustrating a variation of the assembly.

FIG. 8 illustrates a lock assembly 54 similar to that shown in FIG. 3, but modified for wireless locking and unlocking rather than (or in addition to) a key or key pad being used for the locking and unlocking function. The lock assembly 54 may still include a rotating pawl 60, pawl shaft 62 and locking pawl 64. In addition, the lock assembly 54 may include a receiver 100, for receiving wireless locking and unlocking signals, a power source 102, such as a battery, an actuator 106, for causing rotation of the rotating pawl 60, and a controller 104, for receiving and verifying a signal from the receiver 100 and activating the actuator 106. The actuator 106 may be, for example, an electric motor or a solenoid valve. The controller 104 may include conventional encryption algorithms employed to ensure that the wireless signal is from the correct transmitter. A key fob 108 may include a lock/unlock button (s) for causing a wireless signal 112 to be transmitted to the receiver 100. The configuration and operation of the key fob 108 may be conventional and so will not be shown or discussed in more detail herein. This wireless locking and unlocking assembly may also be employed with the configurations shown in FIGS. 4-7, if so desired.

While certain embodiments of the present invention have been described in detail, those familiar with the art to which this invention relates will recognize various alternative designs and embodiments for practicing the invention as defined by the following claims.

What is claimed is:

1. A charge cord assembly for a vehicle having a charging receptacle for engaging the charge cord assembly during battery pack recharging, the charge cord assembly comprising:

an electric cord configured for extending between a source of electric current and the charging receptacle;

a cord end connector operatively engaging the electric cord and having a electrical socket configured to engage the charging receptacle, a latch hook configured to selectively secure the cord end connector to the charging receptacle, a release handle, and a release linkage assembly engaged between the release handle and the latch hook and configured to release the latch hook from the charging receptacle when the release handle is actuated;

a lock assembly configured to have a locked position that prevents the release linkage assembly from releasing the latch hook from the charging receptacle and an unlocked position that allows the release linkage assembly to release the latch hook from the charging receptacle when the release handle is actuated; and wherein the lock assembly is configured to restrict the movement of the release linkage assembly when the lock assembly is in the locked position, and wherein the release linkage assembly includes a first lever pivotable about a first pivot location when the release handle is actuated, a second lever connected to the first lever at a connection location and pivotable about a second pivot location when the first lever is pivoted, the second lever configured to move the latch hook when pivoted; and wherein the lock assembly is configured to restrict movement of the first and second levers at the connection location when the lock assembly is in the locked position.

2. The charge cord assembly of claim 1 wherein the lock assembly includes a lock cylinder with a key slot, the lock cylinder configured to be movable between the locked position and the unlocked position when a key is inserted into the key slot and rotated.

3. The charge cord assembly of claim 1 wherein the lock assembly includes a locking pawl configured to be rotatable by the lock assembly between a first position that restricts movement of the linkage assembly when the lock assembly is in the locked position and a second position that does not limit movement of the linkage assembly when the lock assembly is in the unlocked position.

4. The charge cord assembly of claim 1 wherein the lock assembly includes a receiver configured to receive a wireless signal, an actuator configured to move the lock assembly between the locked position and the unlocked position, and a controller configured to process the wireless signal from the receiver and activate the actuator to move between the locked position and the unlocked position.

5. A charge cord assembly for a vehicle having a charging receptacle for engaging the charge cord assembly during battery pack recharging, the charge cord assembly comprising:

an electric cord configured for extending between a source of electric current and the charging receptacle;

a cord end connector operatively engaging the electric cord and having a electrical socket configured to engage the charging receptacle, a latch hook configured to selectively secure the cord end connector to the charging receptacle, a release handle, and a release linkage assembly engaged between the release handle and the latch hook and configured to release the latch hook from the charging receptacle when the release handle is actuated;

a lock assembly configured to have a locked position that restricts movement of the release linkage assembly to prevent the release linkage assembly from releasing the latch hook from the charging receptacle when the release handle is actuated and an unlocked position that allows the release linkage assembly to release the latch hook from the charging receptacle when the release handle is actuated; and wherein the release linkage assembly includes a first lever pivotable about a first pivot location when the release handle is actuated, a second lever connected to the first lever at a connection location and pivotable about a second pivot location when the first lever is pivoted, the second lever configured to move the latch hook when pivoted; and wherein the lock assembly is configured to restrict movement of the first and second levers at the connection location when the lock assembly is in the locked position.

6. The charge cord assembly of claim 5 wherein the lock assembly includes a lock cylinder with a key slot, the lock cylinder configured to be movable between the locked position and the unlocked position when a key is inserted into the key slot and rotated.

7. The charge cord assembly of claim 5 wherein the lock assembly includes a locking pawl configured to be rotatable by the lock assembly between a first position that restricts movement of the linkage assembly when the lock assembly is in the locked position and a second position that does not limit movement of the linkage assembly when the lock assembly is in the unlocked position.

8. A charge cord assembly for a vehicle having a charging receptacle for engaging the charge cord assembly during battery pack recharging, the charge cord assembly comprising:

an electric cord configured for extending between a source of electric current and the charging receptacle;

a cord end connector operatively engaging the electric cord and having a electrical socket configured to engage the charging receptacle, a connector housing, a latch hook configured to selectively secure the cord end connector to the charging receptacle, a release handle extending from the connector housing, and a release linkage assembly engaged between the release handle and the latch hook and configured to release the latch hook from the charging receptacle when the release handle is actuated; and a hollow locking cover configured to selectively telescopically slide over at least the portion of the connector housing from which the release handle extends to selectively block access to the release handle, the locking cover including a lock assembly configured to have a locked position that prevents the removal of the locking cover from the connector housing when the lock assembly is in the locked position, blocking access to the release handle, and an unlocked position that allows removal of the locking cover from the connector housing when the lock assembly is in the unlocked position, allowing access to actuate the release handle, which allows the release linkage assembly to release the latch hook from the charging receptacle when the release handle is actuated.

9. The charge cord assembly of claim 8 wherein:

the electric cord includes a cord support secured to the connector housing and including a retaining slot; and the lock assembly includes a clip that is configured to engage the retaining slot and prevent removal of the locking cover from the connector housing when the lock assembly is in the locked position and disengage the retaining slot, allowing for removal of the locking cover from the connector housing when the lock assembly is in the unlocked position.

10. The charge cord assembly of claim 9 wherein:

the lock assembly includes a locking pawl configured to be rotatable between a first position when the lock assembly is in the locked position and a second position when the lock assembly is in the unlocked position;

the clip includes a C-shaped member configured to be slidable into and out of the retaining slot and a shaft portion engaged with the locking pawl; and a spring configured to engage the clip to bias the clip toward the retaining slot.

11. The charge cord assembly of claim 8 wherein the lock assembly includes a lock cylinder with a key slot, the lock cylinder configured to be movable between the locked position and the unlocked position when a key is inserted into the key slot and rotated.

* * * * *